US009956436B2

(12) United States Patent
Rogelja

(10) Patent No.: US 9,956,436 B2
(45) Date of Patent: May 1, 2018

(54) ROPE ACCESS EQUIPMENT

(71) Applicant: Andrew Rogelja, Coraki (AU)

(72) Inventor: Andrew Rogelja, Coraki (AU)

( * ) Notice: Subject to any disclaimer, the term of this patent is extended or adjusted under 35 U.S.C. 154(b) by 0 days. days.

(21) Appl. No.: 14/896,503

(22) PCT Filed: Jun. 5, 2014

(86) PCT No.: PCT/AU2014/050063
§ 371 (c)(1),
(2) Date: Dec. 7, 2015

(87) PCT Pub. No.: WO2014/194381
PCT Pub. Date: Dec. 11, 2014

(65) Prior Publication Data

US 2016/0107005 A1 Apr. 21, 2016

(30) Foreign Application Priority Data

Jun. 7, 2013 (AU) ..... 2013902070

(51) Int. Cl.
*A62B 1/14* (2006.01)
*A62B 35/00* (2006.01)
*A63B 29/02* (2006.01)

(52) U.S. Cl.
CPC ..... *A62B 1/14* (2013.01); *A62B 35/0043* (2013.01); *A62B 35/0075* (2013.01); *A62B 35/0081* (2013.01); *A63B 29/02* (2013.01)

(58) Field of Classification Search
CPC ..... A62B 1/14; A62B 35/0043
See application file for complete search history.

(56) References Cited

U.S. PATENT DOCUMENTS 119,997 A * 10/1871 Rice ..... A62B 1/14 182/6
432,044 A * 7/1890 Hepting ..... A62B 1/14 188/65.2

(Continued)

FOREIGN PATENT DOCUMENTS

WO WO 2006/064186 A1 6/2006
WO WO 2012035514 A1 * 3/2012 ..... A62B 35/0043

OTHER PUBLICATIONS

European Search Report dated Dec. 9, 2016 issued in corresponding European Patent Application 14806943.8 filed on Jun. 5, 2014 (9 pgs).

(Continued)

*Primary Examiner* — Alvin C Chin-Shue
(74) *Attorney, Agent, or Firm* — Stinson Leonard Street LLP

(57) ABSTRACT

A fall restraint kit for rope access work may include a length of rope (1), at least two rope braking devices (2*a*, 2*b*) permanently attached to the rope, at least two rope ascender devices (3) at least five karabiners (4, 5) at least two rope pulleys (6) and at least two slings (7, 8). The application discloses improved roping arrangements suitable for working at heights using a number of those components. In one basic fall restraint arrangement a first rope braking device (2*a*) is attached to an anchor point (18), a second rope baking device (2*b*) is attached to a person (22), typically via a harness and a length of rope (1) extends between the first and second rope braking devices. In the event of a fall, or accident, the person may safely lower themselves to ground using the second rope braking device (2*b*), or may be lowered to ground by a colleague/operator (20) located at the anchor point (18) operating the first rope braking device.

7 Claims, 8 Drawing Sheets

(56) References Cited

U.S. PATENT DOCUMENTS

| | | | | |
|---|---|---|---|---|
| 1,516,564 | A | 11/1924 | Barthelemy | |
| 5,927,438 | A | 7/1999 | Ostrobrod | |
| 6,415,602 | B1 * | 7/2002 | Patchett | B01D 53/90 60/274 |
| 7,942,242 | B1 * | 5/2011 | O'Connor | A62B 1/14 182/189 |
| 8,464,832 | B1 * | 6/2013 | Rullo | A62B 35/0037 182/192 |
| 2007/0102240 | A1 * | 5/2007 | Wilson | A62B 1/14 182/5 |
| 2008/0060872 | A1 | 3/2008 | Wise | |
| 2010/0122874 | A1 | 5/2010 | Harris, Jr. | |
| 2010/0126802 | A1 * | 5/2010 | Delaittre | A62B 1/14 182/133 |
| 2012/0118666 | A1 * | 5/2012 | Raoul Bingham | A63B 29/02 182/5 |
| 2012/0241700 | A1 | 9/2012 | Mauthner et al. | |

OTHER PUBLICATIONS

International Search Report and Written Opinion dated Sep. 9, 2014 for International Application No. PCT/AU2014/050063.

* cited by examiner

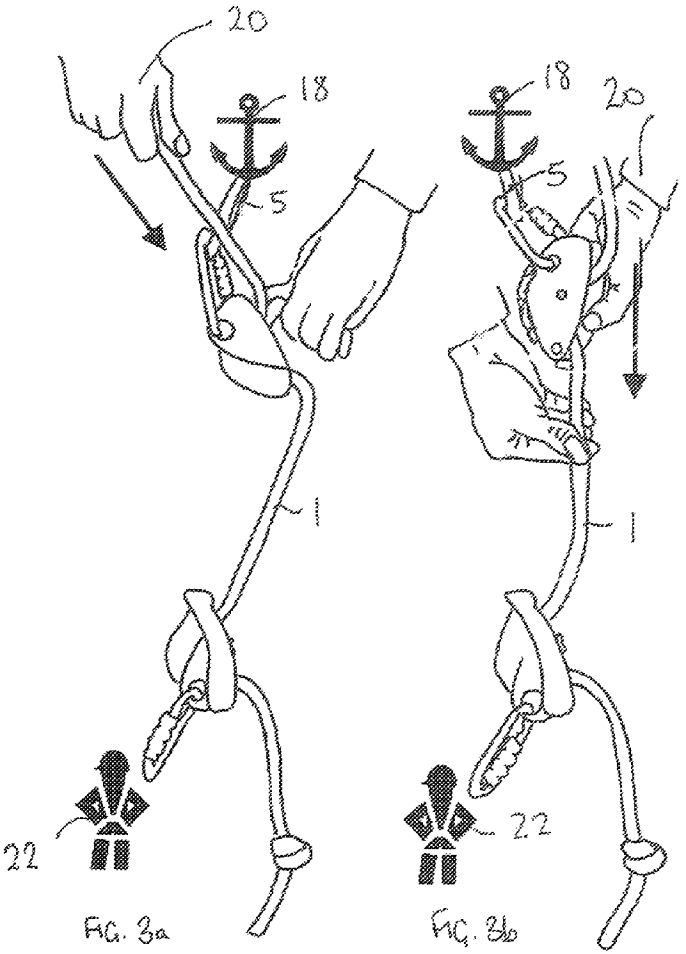
FIG. 3a
FIG. 3b
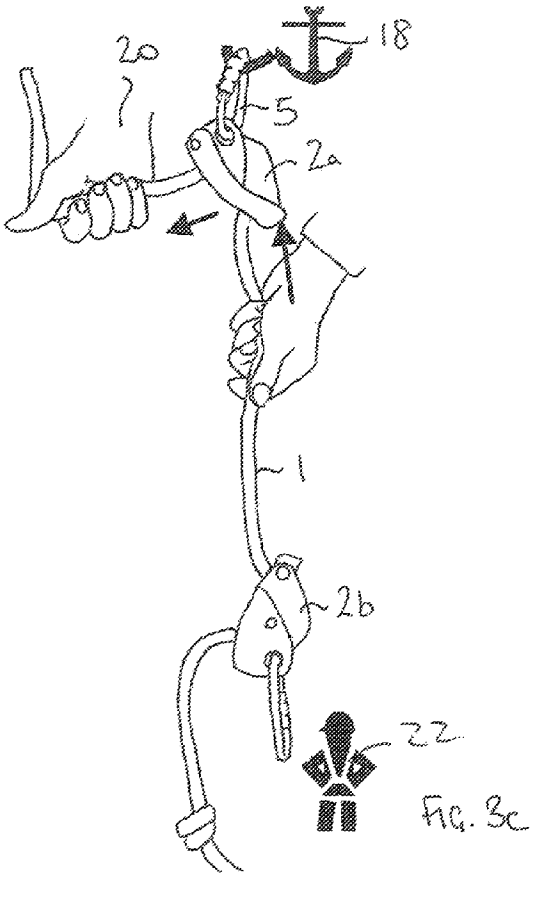
FIG. 3c

ROPE ACCESS EQUIPMENT

CROSS-REFERENCE TO RELATED APPLICATIONS

The present application claims priority from Australian Provisional Patent Application No 2013902070 filed on 7 Jun. 2013, the content of which is incorporated herein by reference.

TECHNICAL FIELD

This invention relates to improvements in rope access equipment and systems and in particular to rope based safety arrangements including work position and for providing fall restraint for safe working at heights. Other applications may include rope access, Tower rescue, vertical rescue and confined space entry and exit.

BACKGROUND

Rope access equipment is used in many different applications where persons are working at heights. Some common, non-limiting, examples of persons who will commonly use rope access equipment include workers in building and construction, roofers, bridge workers, window cleaners, tree loppers and emergency service workers such as firefighters.

One main function of existing rope access equipment is to provide rope based safety arrangements to arrest or stop the worker from falling to ground should they slip or fall when working at heights. While most existing systems do this satisfactorily, one main problem is that the person whose fall is arrested is typically unable to help themselves after they have fallen, even if they are conscious and uninjured. The person may, for example, be left dangling from the top of a roof adjacent a wall of a building but is unable to move without assistance. To rescue them will require assistance from a co-worker, assuming that the worker has the required skills and qualifications to perform a rescue or may involve the use of emergency services personnel. Also, if the person is left dangling from a rope, they run the risk of injury if they are not rescued quickly.

One additional problem with existing rope access equipment is that they typically only arrest a fall and do not prevent falls completely ("fall restraint").

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY

In a first broad aspect, the present invention provides an rope based safety arrangement comprising a rope based safety arrangement for working at heights comprising a first rope braking device for attachment to an anchor point, a second rope braking device for attachment to a person typically via a harness, or to an anchor point, and a length of rope extending between the first and second rope braking devices, the arrangement being such that in the event of a fall, or accident, a person supported by the rope between the first and second rope braking devices may be safely lowered towards ground using either rope braking device.

A related aspect provides a combination of a rope and two braking devices, for use in the safety arrangement of the first aspect comprising a first rope braking device, a second rope braking device and a rope passing through the first and second rope braking devices, the rope having ends and including knots or stops between the ends and the braking devices to prevent the braking devices from sliding off the ends of the rope and wherein the braking devices are locked onto the rope to prevent their disengagement from the rope.

Advantageously the arrangement provides a system which is both safe and which enables a rescue of a casualty as a result of a fall or accident in as little as 30 seconds without the need for emergency services assistance.

In one arrangement, the second rope braking device is attached to a person and the person may safely lower themselves towards ground using the second rope braking device, or may be lowered towards ground by an operator located at the anchor point by means of the first rope braking device.

The system may further include an ascender attached to the rope between the first and second rope braking devices a pulley attached between a free end of the rope and the rope braking device and a karabiner linking the pulley and ascender to create a mechanical advantage when pulling on the free end of the rope.

Typically, the ascender includes a cam which allows the device to slide freely in one direction and provides a firm grip on the rope when pulled on in the opposite direction.

The system is fully reversible and allows the person to be raised or lowered from either end of the arrangement of from both ends at the same time.

The rope braking device provides a restricted pathway through which the rope passes that slows the rate of passage of the rope through the device and which typically includes a cam surface and a handle which is used to manually control the rate. The rope braking device is preferably arranged to stop the passage of rope when the handle is not being operated.

It is preferred that the rope is constructed with an inner core and an external sheath, preferably woven, for maximum strength and durability. Static kernmantle rope is preferred. The fibres of the core provide the tensile strength of the rope while the sheath protects the core from abrasion during use. Kernmantle rope is designed so that the sheath tears prior to complete severing of the rope. When the sheath shows damage, the rope is discarded and replaced.

The braking devices act as a shock absorber creating a type of fuse/overload indicator to reduce the risk of a total system failure. In particular in the event of a fall the braking device will slide for a short distance before locking. If the distance of the fall and the load is sufficiently high, the exterior sheath of the rope may melt. This is visible and indicates that the rope and braking devices combination should be discarded and replaced. In a more severe fall under heavier load the sheath may tear. However the rope should not fail. Again this is visible and indicates that the rope and braking devices combination should be discarded and replaced.

Typically karabiners will be used to attach the rope braking devices to anchor points/harnesses or the like. The karabiners used may comprise a mix of triplock karabiners and screwgate karabiners.

In one arrangement the second rope braking device is attached to an anchor point and the person is attached to the rope between the first and second rope braking devices. The person may be free to move along the rope.

In a yet further aspect the invention provides a fall restraint kit for rope access work comprising:

a length of rope;

at least two rope braking devices;

at least one rope ascender device;

at least two karabiners;

at least one rope pulley; and an instruction manual containing instructions for setting up a rope based safety arrangement as claimed in any one of the preceding claims.

It is preferred that the at least two rope braking devices are attached to the rope with the rope passing through the first and second rope braking devices, the rope having ends and including knots or stops between the ends and the braking devices to prevent the braking devices from sliding off the ends of the rope and wherein the braking devices are locked onto the rope to prevent their disengagement from the rope.

The locking may be by means of ties or the like preventing opening of the braking devices.

BRIEF DESCRIPTION OF DRAWINGS

Specific embodiments of the present invention will now be described, by way of example only, and with reference to the accompanying drawings, in which:

FIGS. 3*a* to 3*c* show the arrangement of FIG. 2 used for lowering under load, feeding out, and taking in slack, respectively;

DESCRIPTION OF EMBODIMENTS

Figure 1A:
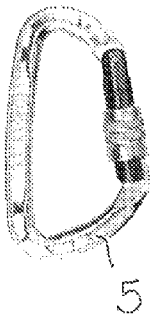
FIGS. 1*a* to 1*e* show image of various components of a kit of parts for use with the present invention.
Figure 1B:
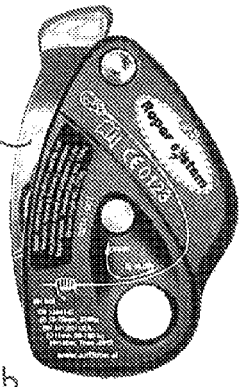
Figure 1C:
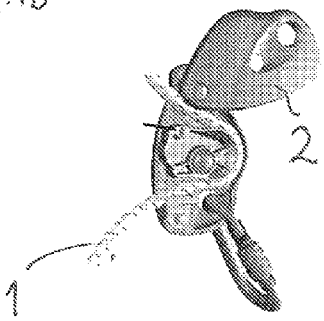
Figure 1D:
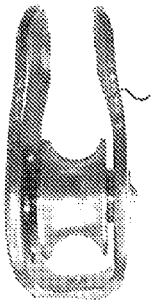
Figure 1E:
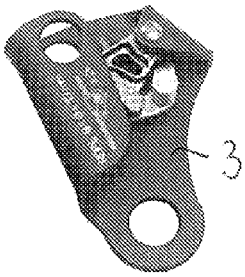

Turning to the drawings, FIG. 1 shows components of a kit of parts which can be arranged in a number of different rope access arrangements. The kit includes a rope 1, most preferably a static nylon kernmantle rope. The length of the rope used will vary depending on the application, though typically the kit will be supplied with 20 m of rope. The kit includes two rope braking devices 2, two rope ascenders 3 (of which only one is shown), five karabiners 5, typically screwgate karabiners, two rope pulleys 6 (one only is shown), a 1200 mm sling, a 2400 mm sling, an instruction manual and log book, and a kit bag (not shown). A rope braking device is a device that a rope passes through to create a restricted pathway that slows and controls the rate of passage of the rope through the device and typically includes a cam surface and a handle which is used to manually control the rate. The braking device may be opened to allow a rope to be threaded through the device. The braking device is arranged to stop the passage of rope when the handle is not being operated. The term is intended to exclude devices which do not include moving parts for controlling the rate, but which control the passage of rope merely by the angle or position of the tail of the rope is held at.

An ascender is another known item of equipment which employs a cam which allows the device to slide freely in one direction (usually the intended direction of movement), and provides a firm grip on the rope when pulled on in the opposite direction. Hence it can be used to ascend a rope while preventing descent down the rope.

Figure 2:
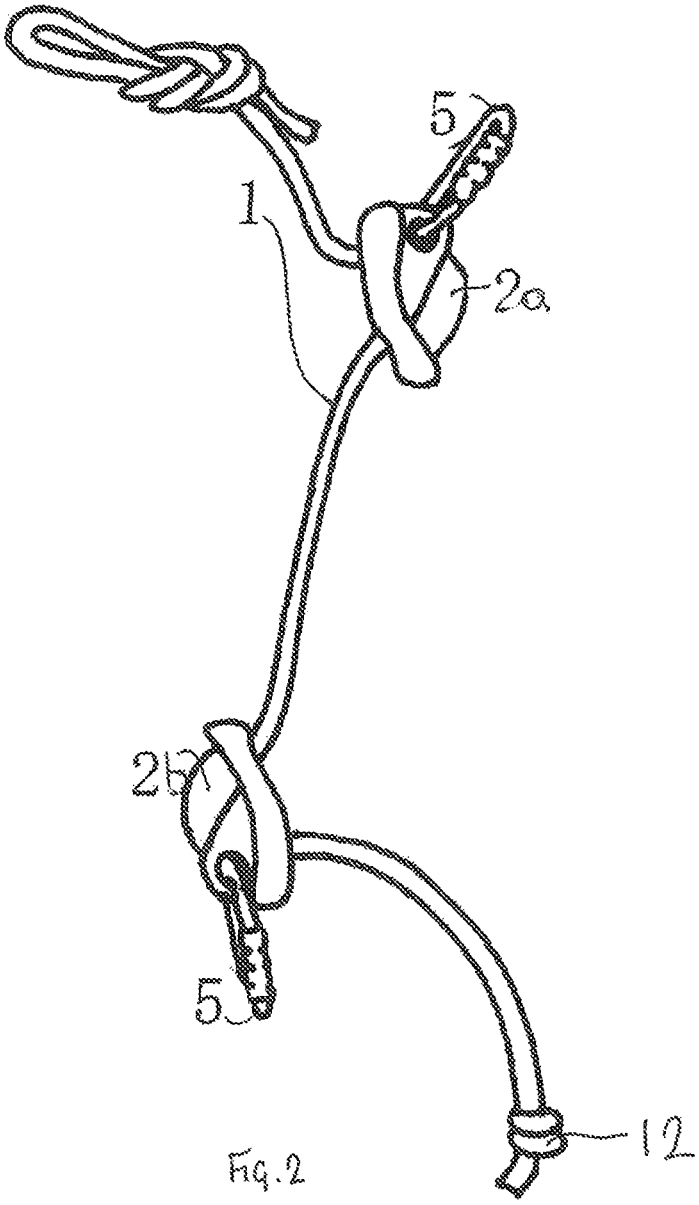
FIG. 2 shows a first arrangement in which components of the kit are arranged in a basic fall restraint configuration.

FIG. 2 shows a first arrangement in a basic fall restraint configuration. In this arrangement the rope 1 extends between two spaced apart braking devices 2, an upper braking device 2*a* and a lower braking device 2*b*. It is preferred that the braking devices are substantially permanently attached to the rope to substantially prevent both accidental and intended removal of the braking devices from the rope. This may be achieved by locking the devices in the closed (operating) position, using cable ties or the like which prevent the braking device from opening. Both ends of the rope have a permanent knot, stop or enlargement or other means to prevent the braking devices from sliding off. In this way the risk of incorrect use or set up of the equipment is reduced. FIG. 2 shows the lower end of the rope knotted at 12 to prevent the end of the rope passing through the lower braking device 2*b*. A karabiner is used to attach the upper braking device 2*a* to an anchor point, not shown, and the lower braking device is attached to a harness of the person/operator who is to use the system. The user operates the system by taking in or giving slack rope. Slack rope should be minimised so that fall height is minimised in the event of an accident. The arrangement shown in FIG. 2 can be used in various applications, from a person climbing or descending a steep slope to working at heights.

To give one example, a roofer may be using the system on a sloping roof and may slip off the roof, in which case the system will arrest his fall. Using existing safety systems the roofer would be left dangling from the roof and would typically have to wait to be rescued by emergency services. Using the configuration shown in FIG. 2, a number of different rescue possibilities exist illustrated in FIGS. 3*a* to 3*c*. In those Figures, the anchor point 18 for the upper braking device 2*a* is shown. If the roofer/operator 22 is conscious and sufficiently close to ground, they can simply use the lower braking device 2*b* to lower themselves to ground, if working alone (which is not recommended). If they are working with a partner 20 on the top of the roof adjacent the braking device 2*a*, the partner may lower the roofer/person 22 to ground using the upper braking device 2*a*, illustrated in FIG. 3*a*. As discussed in more detail below, it is also possible for the partner 20 to also raise the person 22, although that may require a pulley system to create a mechanical advantage.

Figure 4:
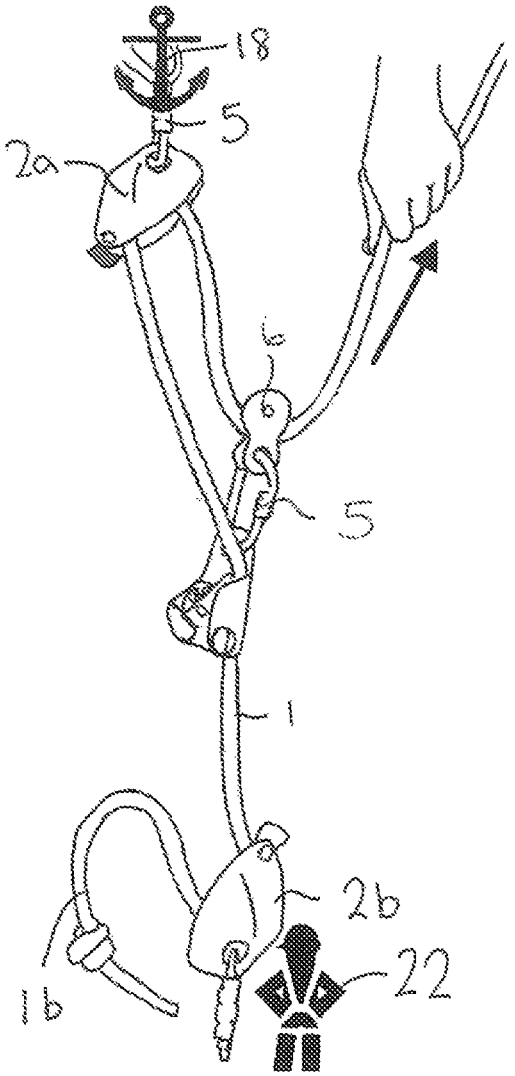
FIG. 4 shows the arrangement of FIG. 2 modified using additional components to create a mechanical advantage to raise a person.

The braking devices act a shock absorber creating a type of fuse/overload indicator to reduce the risk of a total system failure. In particular in the event of a fall the braking device will slide for a short distance before locking. If the distance of the fall and the load is sufficiently high, the exterior sheath of the rope may melt. This is visible and indicates that the rope and braking devices combination should be discarded and replaced. In a more severe fall under heavier load the sheath may tear. Again this is visible and indicates that the rope and braking devices combination should be discarded and replaced FIG. 4 illustrates the person being raised. In this arrangement the upper operator/partner 20 attaches an ascender 3 to the rope between the braking devices, close to the upper braking device 2*a*. Next a pulley 6 is placed on the rope and connected to the ascender by means of a karabiner 5. Pulling on the rope results in the casualty being raised with a 3:1 mechanical advantage. Note however, that it is generally easier and quicker to lower the person 22 than raise them, taking about one third of the time.

This pulley arrangement can also be created using the lower braking device in which case the ascender 3 is attached to the rope 1 between the braking devices close to the lower device 2*b*, and the pulley to the end of the rope 1*b* and linked to the ascender 3 by a karabiner 5. This creates a 3:1 mechanical advantage which may allow the person 22 to haul his or herself up the rope 1. It would however be simpler for the operator to lower his or herself if they are sufficiently close to ground and the operator would need to be carrying the necessary components at the time he or she fell.

In the arrangement shown in FIG. 3, where the person 22 is working with a partner 20, the partner may use the upper braking device to take in/give slack (illustrated in FIGS. 3*b* and 3*c* respectively) or lower the person so that the person has both hands free to perform tasks.

Figure 5:
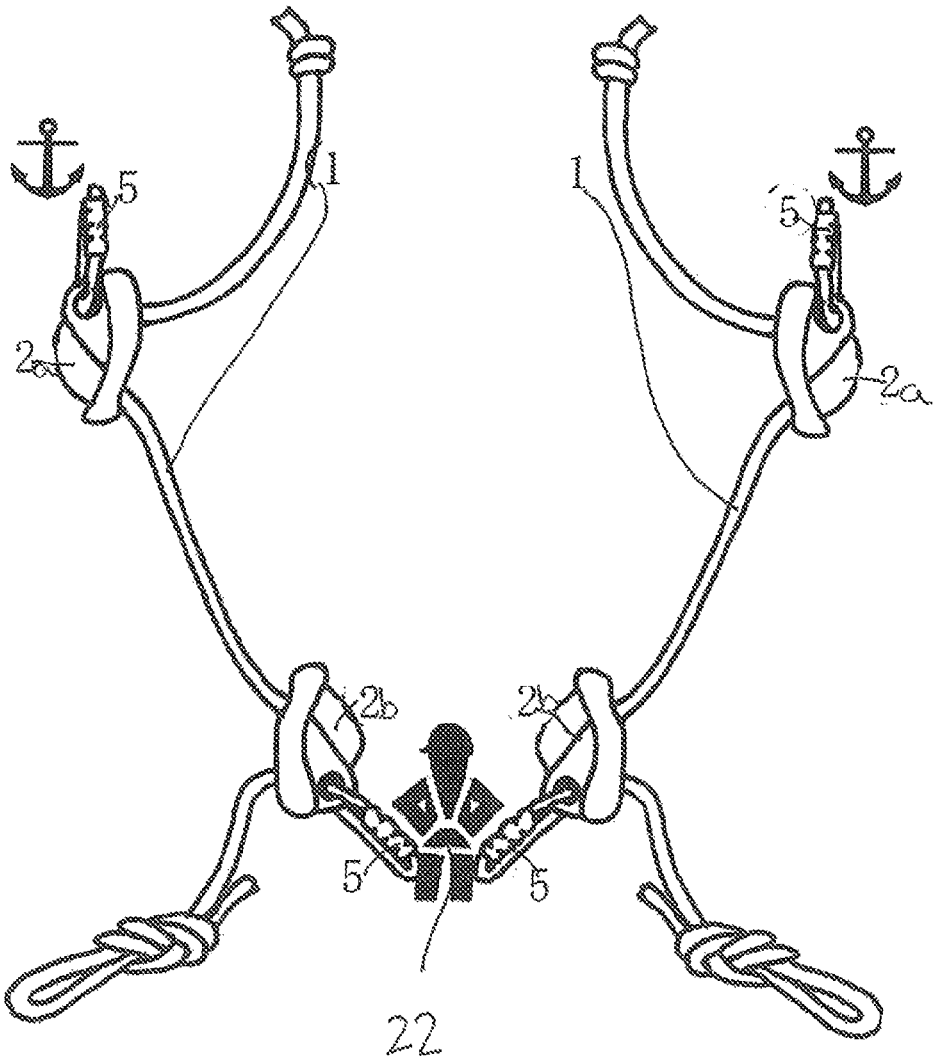
FIG. 5 shows an arrangement using two kits in which the arrangement of FIG. 2 is duplicated.

FIG. 5 shows an arrangement using two kits in which the arrangement of FIG. 2 is duplicated. This system allows the operator/person 22 to freely and safely move up and down and horizontally even on completely vertical areas. The two kits form a work positioning configuration with the second kit being a back up.

Figure 6:
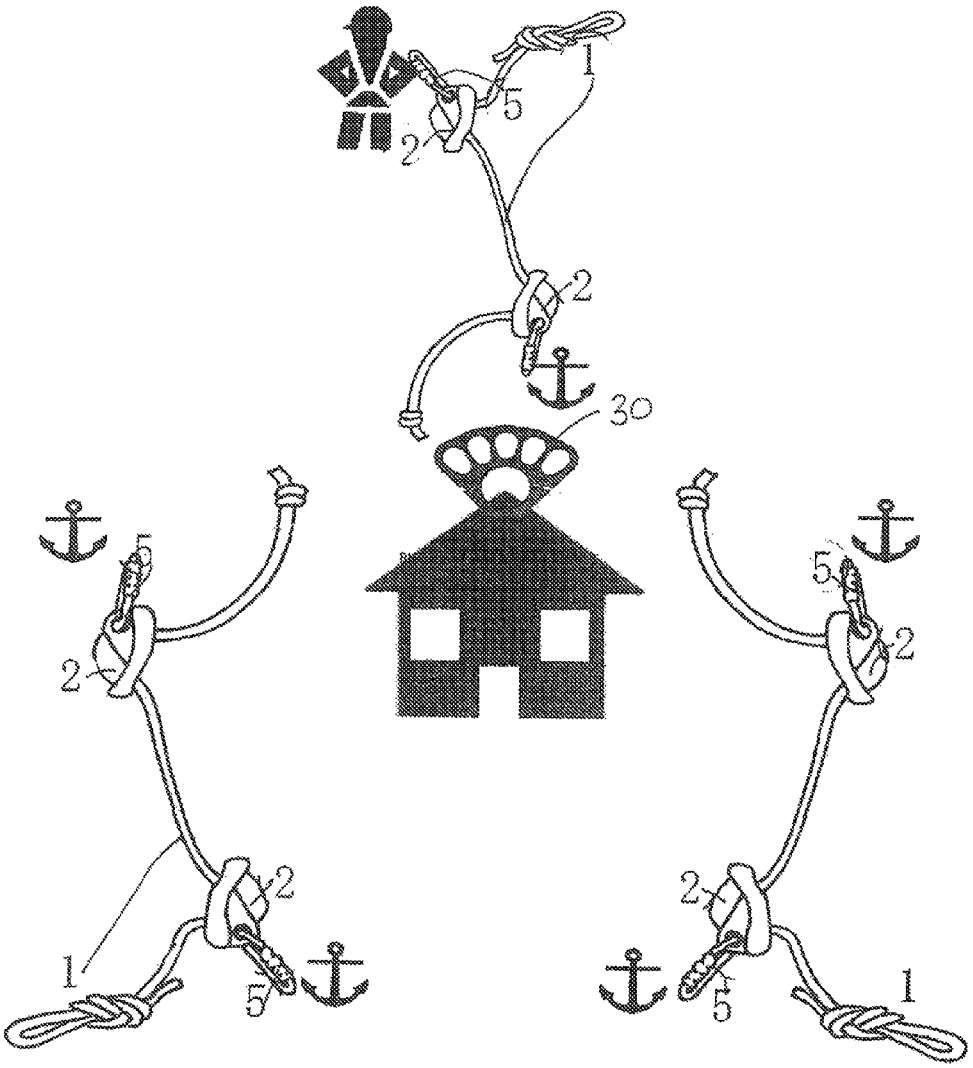
FIG. 6 is a schematic drawing showing an arrangement in which three kits are used to support at least three persons/operators from a roof via a rigging plate.

FIG. 6 shows an arrangement in which three kits are used. Two kits are anchored on the non-working side of the structure extending over the roof and attaching to a rigging plate 30 anchored at the centre of the top of the roof. Up to three additional kits to support up to three persons/operators, each in the same arrangement as shown in FIG. 2, are attached to the rigging plate 30. In the Figure the karabiners are not shown connected to the plate 30 for clarity.

Figure 7:
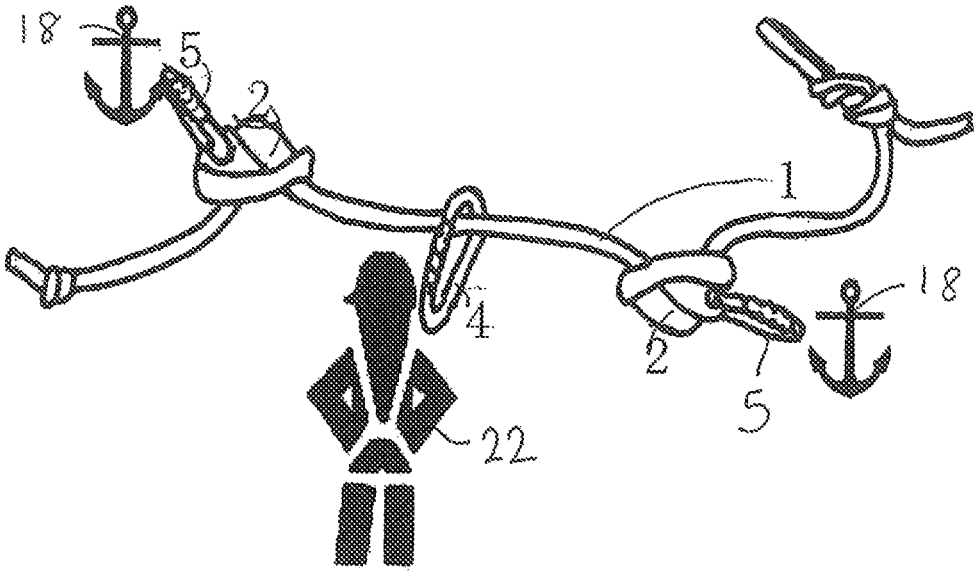
FIG. 7 shows components of the kit are arranged in a horizontal static line configuration.
Figure 8:
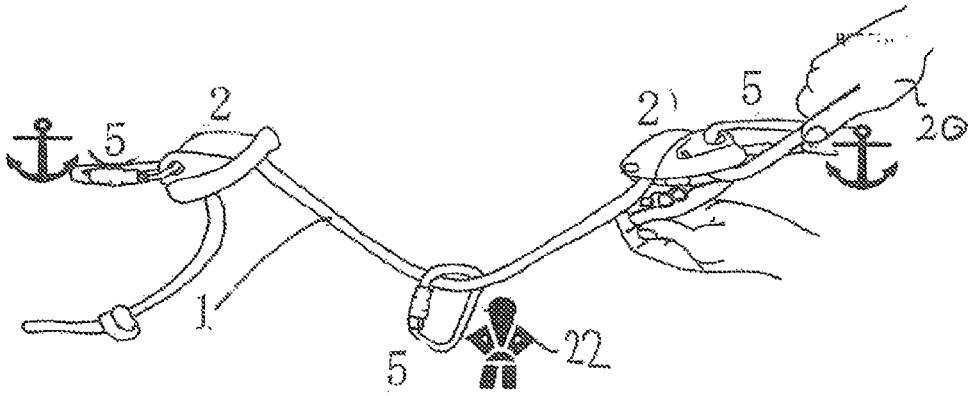
FIG. 8 illustrates lowering a person using the horizontal static line configuration of FIG. 7.
Figure 9:
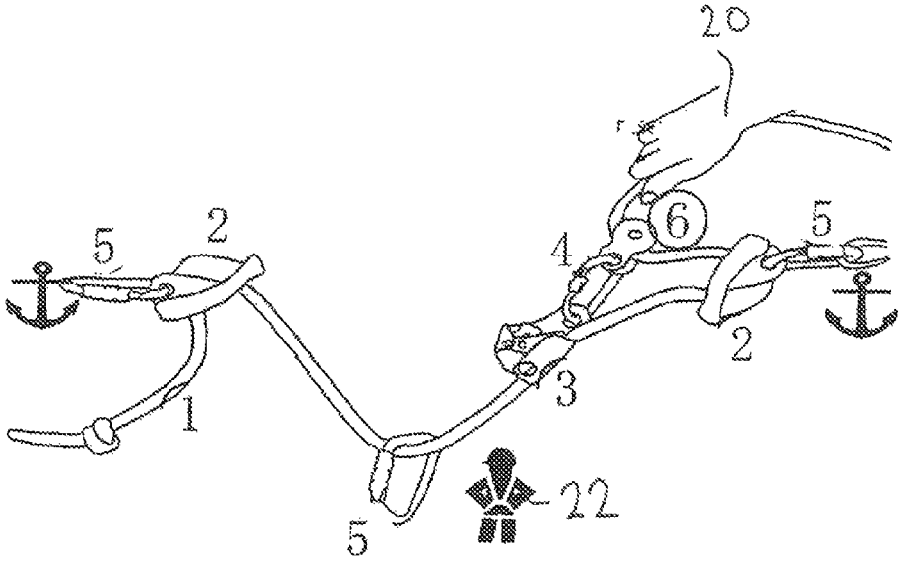
FIG. 9 illustrates raising a person using the horizontal static line configuration of FIG. 7.

FIGS. 7 to 9 illustrate components of the kit used in a static line configuration. This arrangement is suitable for more experienced trained operators, with the basic fall restraint system being safer and thus preferred. Ideally the line will be supported by a number of intermediate anchors, not shown, preferably spaced at 5 m horizontal intervals. In the horizontal line configuration, the rope 1 is connected between the two rope braking devices each of which is attached to an anchor point 18 by means of a karabiner 5. The operator 22 is attached to the line via a karabiner 5.

In the event of an accident the operator 22 may be lowered to ground using either rope braking device 2, as shown in FIG. 8, by a single rescuer 20.

FIG. 9 shows an arrangement in which an ascender 3 and pulley are used to create a 3:1 mechanical advantage to raise the operator 22.

Thus the system of the present invention may be used for safe work at heights, rope access, tower rescue, vertical rescue and confined space entry and exit. The system may be used in a number of configurations as follows:

basic fall restraint; top rope; work positioning; adjustable anchor; roof kit; equipment raise and lower; rescue recovery; advanced rescue; confined space entry/exit; temporary horizontal static line; zipline; and self-equalising and load sharing anchors.

It will be appreciated that the above list is non-limiting.

By permanently attaching the braking devices to the rope, the risk of incorrect set up and use of the equipment is minimised, and this allows safer use by less experienced persons and person who do not use the equipment on a regular or daily basis.

It will be appreciated that while the description refers to 3:1 mechanical advantages when using the system, that it can be set up with a mechanical advantage of anything from 2:1 to 6:1 or greater.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A rope based safety arrangement for working at heights comprising a first rope braking device configured for attachment to an anchor point, a second rope braking device configured for attachment to a person, and a single length of rope comprising a first and second free end and a knot or stop at the first and second free end, wherein the single length of rope is threaded through and extends between the first and second rope braking devices, wherein the first and second braking devices are locked onto the single length of rope, wherein each of the first and second rope braking devices provides a restricted pathway through which the single length of rope passes that is operable to slow a rate of passage of the rope through the respective one of the first and second rope braking devices and wherein each of the first and second rope braking devices comprises a handle that is operable to control the rate of passage of the rope through the respective one of the first and second rope braking devices, wherein the first braking device along the single length of rope is closer to the first free end than the second braking device; further comprising:

an ascender attached to the single length of rope between the first and second rope braking devices;

a pulley attached on the single length of rope between the first free end and the first rope braking device or between the second free end and the second rope braking device, and a karabiner linking the pulley and the ascender.

2. A rope based safety arrangement for working at heights as claimed in claim 1 wherein the ascender and pulley are positioned adjacent the second rope braking device.

3. A rope based safety arrangement for working at heights as claimed in claim 1 wherein the restricted pathway comprises a cam surface.

4. A rope based safety arrangement for working at heights as claimed in claim 3 wherein each of the first and second rope braking devices is arranged to stop the passage of the single length of rope when the handle is not being operated.

5. A rope based safety arrangement for working at heights as claimed in claim 1 wherein the ascender includes a cam which allows the ascender to slide freely in one direction and provides a firm grip on the rope when pulled on in the opposite direction.

6. A method for working at heights comprising:

providing a rope based safety arrangement comprising a first rope braking device providing a first restricted pathway; a second rope braking device providing a second restricted pathway; and a single length of rope comprising a first and second free end and a knot or stop at the first and second free end, the single length of rope passes through each of the first and second restricted pathways, wherein at least a portion of the single length of rope extends between the first and second rope braking devices, and wherein each of the first and second rope braking devices comprises a handle that is operable to control the rate of passage of the rope through each of the first and second restricted pathways;

wherein the first braking device along the single length of rope is closer to the first free end than the second braking device; further comprising:

an ascender attached to the single length of rope between the first and second rope braking devices;

a pulley attached on the single length of rope between the first free end and the first rope braking device or between the second free end and the second rope braking device, and a karabiner linking the pulley and the ascender to create a mechanical advantage when pulling a respective free end of the rope, and attaching the first rope braking device to an anchor point; attaching the second rope braking device to a harness of a user; and positioning the second rope braking device below the first rope braking device or attaching the second rope braking device to an anchor point; attaching the first rope braking device to a harness of a user; and positioning the first rope braking device below the second rope braking device.

7. The method of claim 6, wherein the ascender and the pulley are positioned adjacent the second rope braking device for operation by the user.

* * * * *